US010303082B2

(12) United States Patent
Ozeki et al.

(10) Patent No.: US 10,303,082 B2
(45) Date of Patent: May 28, 2019

(54) IMAGE FORMING APPARATUS

(71) Applicant: Oki Data Corporation, Tokyo (JP)

(72) Inventors: Fumitaka Ozeki, Tokyo (JP); Takuya Goto, Tokyo (JP); Kentaro Hasegawa, Tokyo (JP); Susumu Yamamoto, Tokyo (JP); Kazuoki Katayama, Tokyo (JP); Tsukasa Hirayama, Tokyo (JP); Hisashi Soga, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/787,282

(22) Filed: Oct. 18, 2017

(65) Prior Publication Data

US 2018/0113397 A1 Apr. 26, 2018

(30) Foreign Application Priority Data

Oct. 24, 2016 (JP) ..... 2016-207831

(51) Int. Cl.

| | |
|---|---|
| ***G03G 15/06*** | (2006.01) |
| ***G03G 15/08*** | (2006.01) |
| ***G03G 15/00*** | (2006.01) |
| *G03G 21/20* | (2006.01) |

(52) U.S. Cl.

CPC ..... *G03G 15/065* (2013.01); *G03G 15/0806* (2013.01); *G03G 15/0812* (2013.01); *G03G 15/50* (2013.01); *G03G 21/203* (2013.01)

(58) Field of Classification Search

CPC ..... G03G 15/065

See application file for complete search history.

(56) References Cited

U.S. PATENT DOCUMENTS

2018/0024483 A1* 1/2018 Kato ..... G03G 15/0865 399/94

FOREIGN PATENT DOCUMENTS

JP H03-255482 A 11/1991

* cited by examiner

*Primary Examiner* — David M. Gray
*Assistant Examiner* — Andrew V Do
(74) *Attorney, Agent, or Firm* — Muncy, Geissler, Olds & Lowe, P.C.

(57) ABSTRACT

An image forming apparatus executes an image formation process through which a developer image is formed on an image carrier by developing an electrostatic latent image while rotating a developer carrier in a forward direction, a voltage controller controls development and regulating voltages after the image formation process such that a magnitude relationship between the development regulating voltages becomes inverted from that during the image formation process, and after finishing the image formation process, in a state where the magnitude relationship between the development and regulating voltages is inverted from that during the image formation, the drive controller rotates the developer carrier in the forward direction for a prescribed period, and afterwards rotates the developer carrier in a reverse direction for another prescribed period.

15 Claims, 10 Drawing Sheets

| | 1st Volt. Value | 2nd Volt. Value |
|---|---|---|
| Charging Volt. | -1000 | -950 |
| Regulating Volt. | -200 | -100 |
| Development Volt. | -150 | -200 |

| | Control Conditions | | Print Piece No. | | | |
|---|---|---|---|---|---|---|
| | Motor Reverse Rotation | 2nd Volt. Value | 0 | 10000 | 20000 | 30000 |
| 2nd Comp. Target Device | No | No | ○ | × | × | × |
| 1st Comp. Target Device | Yes | No | ○ | ○ | ○ | × |
| Image Forming Apparatus 1 | Yes | Yes | ○ | ○ | ○ | ○ |

*Fig. 10*

Tb1

| Envi. Value e | | Humidity H (%) | | | | | | | | |
|---|---|---|---|---|---|---|---|---|---|---|
| | | H<10 | 10≦H<20 | 20≦H<30 | 30≦H<40 | 40≦H<50 | 50≦H<60 | 60≦H<70 | 70≦H<80 | 80≦H |
| Temp. T (C°) | T<5 | 8 | 8 | 8 | 8 | 8 | 7 | 7 | 7 | 7 |
| | 5≦T<10 | 8 | 8 | 8 | 7 | 7 | 7 | 6 | 6 | 6 |
| | 10≦T<15 | 8 | 8 | 7 | 7 | 6 | 6 | 5 | 5 | 4 |
| | 15≦T<20 | 8 | 8 | 7 | 6 | 5 | 5 | 4 | 4 | 3 |
| | 20≦T<25 | 8 | 7 | 6 | 5 | 4 | 4 | 3 | 2 | 2 |
| | 25≦T<30 | 8 | 7 | 5 | 4 | 3 | 3 | 2 | 1 | 1 |
| | 30≦T<35 | 8 | 6 | 5 | 3 | 2 | 2 | 1 | 1 | 1 |
| | 35≦T<40 | 8 | 6 | 4 | 2 | 2 | 1 | 1 | 1 | 1 |
| | 40≦T | 8 | 5 | 3 | 2 | 1 | 1 | 1 | 1 | 1 |

*Fig. 11*

| | Envi. Value e | | | | | | |
|---|---|---|---|---|---|---|---|
| Conti. Print Piece No. | 1≦e<2 | 2≦e<3 | 3≦e<4 | 4≦e<5 | 5≦e<6 | 6≦e<7 | 7≦e≦8 |
| 50 | 50 | 50 | 50 | 50 | 50 | 50 | 50 |
| 100 | 50 | 50 | 50 | 50 | 50 | 50 | 50 |
| 150 | 50 | 50 | 50 | 50 | 50 | 50 | 50 |
| 200 | 35 | 40 | 45 | 50 | 50 | 50 | 50 |
| 250 | 35 | 40 | 45 | 50 | 50 | 50 | 50 |
| 300 | 35 | 40 | 45 | 50 | 50 | 50 | 50 |

*Fig. 12*

Tb2

| | Envi. Value e | | | | | | |
|---|---|---|---|---|---|---|---|
| | 1≦e<2 | 2≦e<3 | 3≦e<4 | 4≦e<5 | 5≦e<6 | 6≦e<7 | 7≦e≦8 |
| d | 200 | 200 | 200 | 200 | 200 | 200 | 200 |
| a | 1.0 | 1.0 | 1.0 | 1.0 | 1.0 | 1.0 | 1.0 |
| b | 0.7 | 0.8 | 0.9 | 1.0 | 1.0 | 1.0 | 1.0 |
| Z | 50 | 50 | 50 | 50 | 50 | 50 | 50 |

*Fig. 14*

| | Control Conditions | Print Piece No. | | | | |
|---|---|---|---|---|---|---|
| | | 0 | 5000 | 10000 | 20000 | 30000 |
| 2nd Comp. Target Device | Condition (1) | ○ | × | × | × | × |
| Image Forming Apparatus 100 | Condition (2) | ○ | ○ | ○ | ○ | ○ |

* Condition (1): Periodically Reverse Rotation
* Condition (2): Adjust Frequency of Reverse Rotation

IMAGE FORMING APPARATUS

TECHNICAL FIELD

This invention relates to an image forming apparatus and is preferably applicable to image forming apparatuses such as printers, copiers, and multifunction peripherals of an electrophotographic system using a developer.

BACKGROUND

An electrophotographic image forming apparatus using a developer (such as toner) is provided with a photosensitive drum as an image carrier, a charging device, an exposure device, a development device, a transfer device, a fusing device, and a cleaning device. This image forming apparatus forms an electrostatic latent image on the photosensitive drum by exposing the surface of the photosensitive drum uniformly charged by the charging device to light by the exposure device, and forms a toner image on the photosensitive drum by developing this electrostatic latent image by the development device using toner. Afterwards, the toner image is transferred to a sheet of paper by the transfer device and fused to the sheet by the fusing device. Also, toner remaining on the photosensitive drum after the transfer is removed by the cleaning device.

The development device is provided with a toner accommodation part as a developer accommodation part, a supply roller as a developer supply member, a development roller as a developer carrier, and a regulation blade as a regulating member. This development device supplies toner accommodated in the toner accommodation part to the development roller by the supply roller, makes the layer thickness of toner on the development roller uniform by the regulation blade in contact with the development roller, and then has the toner on the development roller adhere to the electrostatic latent image formed on the photosensitive drum, thereby developing the electrostatic latent image.

Conventionally, in such an image forming apparatus as this, foreign bodies such as shavings of the supply roller occasionally become stuffed in the contact place between the development roller and the regulation blade, and in order to remove these foreign bodies, the development roller was periodically rotated in the opposite direction from that during image formation (i.e., during development) (e.g., see Patent Document 1).

RELATED ART

[Patent Doc. 1] JP Laid-Open Patent Publication H03-255482

By the way, other than shavings of the supply roller etc., softly-aggregated toner and its external additive occasionally become stuffed in the contact place between the development roller and the regulation blade. These softly-aggregated toner and its external additive could not be sufficiently removed by simply reverse-rotating the development roller periodically as in the conventional image forming apparatus.

This invention has been made considering the above-mentioned point and proposes an image forming apparatus that can sufficiently remove foreign bodies stuffed in the contact place between the developer carrier and the regulating member.

SUMMARY

An image forming apparatus, disclosed in the application, includes an image carrier that carries an electrostatic latent image, a developer carrier that supplies a developer to the image carrier, a developer accommodation part that accommodates the developer therein, a developer supply member that supplies the developer accommodated in the developer accommodation part to the developer carrier, a regulating member that is in contact with the developer carrier and regulates the developer on the developer carrier, a voltage controller that controls a development voltage applied to the developer carrier and a regulating voltage applied to the regulating member, and a drive controller that controls a rotation of the developer carrier. Wherein, the image forming apparatus executes an image formation process through which a developer image is formed on the image carrier by developing the electrostatic latent image with the developer supplied to the image carrier while rotating the developer carrier in one direction, the one direction being defined as a forward direction, the voltage controller controls the development voltage and the regulating voltage after the image formation process such that a magnitude relationship between the development voltage and the regulating voltage becomes inverted from that during the image formation process, and after finishing the image formation process, in a state where the magnitude relationship between the development voltage and the regulating voltage is inverted from that during the image formation, the drive controller rotates the developer carrier in the forward direction for a prescribed period, and afterwards rotates the developer carrier in a reverse direction, which is an opposite direction from the forward direction, for another prescribed period.

In this manner, in the image forming apparatus of this invention, after finishing image formation, the developer carrier is driven in the same direction as that during image formation in a state where the magnitude relationship between a development voltage and a regulating voltage is reversed from that during image formation. Thereby, in the vicinity of the contact place between the developer carrier and the regulating member, the flow of the developer returning from the contact place to the developer accommodation part becomes larger than that during image formation, and by this flow it becomes easy to remove the softly-aggregated developer stuffed in the contact place. Then, by driving the developer carrier in the opposite direction from that during image formation, the aggregated developer stuffed in the contact place between the developer carrier and the regulating member can be removed from the contact place together with other foreign bodies.

Another image forming apparatus, disclosed in the application, includes an image carrier that carries an electrostatic latent image, a developer carrier that supplies a developer to the image carrier, a developer accommodation part that accommodates the developer therein, a developer supply member that supplies the developer accommodated in the developer accommodation part to the developer carrier, a regulating member that is in contact with the developer carrier and regulates the developer on the developer carrier, a drive controller that controls a rotation of the developer carrier, and a controller that controls the drive controller. Wherein the developer carrier rotates in a forward direction for an image formation process through which a developer image is formed on the image carrier by developing the electrostatic latent image with the developer supplied to the image carrier, the drive controller is configured to allow the developer carrier to rotate in a reverse direction, which is an opposite direction from the forward direction, herein the rotation in the reverse direction is defined as the reverse operation, and the controller acquires environmental information indicating the environment around the contact between the developer carrier and the regulating member, and adjusts an execution frequency to have the drive controller execute the reverse operation in a middle of continuous image formation that continuously performs the image formation process, based on the environmental information and a continuous image formation number based on which a number of the image formation process to be executed is determined.

In this manner, the image forming apparatus of this invention adjusts the execution frequency of an operation to drive the developer carrier in the opposite direction from that during image formation in the middle of continuous image formation based on environmental information and the number of continuously-formed images. Thereby, for example, if there presumed to be a situation where the aggregated developer can be easily stuffed in the contact place between the developer carrier and the regulating member based on the environmental information and the number of continuously-formed images, by increasing the execution frequency of the operation to drive the developer carrier in the reverse direction, the aggregated developer stuffed in the contact place between the developer carrier and the regulating member can be removed from the contact place together with other foreign bodies.

According to this invention, it is possible to realize an image forming apparatus that can sufficiently remove foreign bodies stuffed in the contact place between the developer carrier and the regulating member.

BRIEF DESCRIPTIONS OF THE DRAWINGS

FIG. 10 is a table showing the configuration of an environmental table by the second embodiment.

FIG. 11 is a table showing the execution frequency of the foreign body removal operation adjusted based on the continuous print piece number (or continuous image forming number) and an environmental value by the second embodiment.

FIG. 12 is a table showing the configuration of a parameter table by the second embodiment.

FIG. 14 is a table showing experimental results by the second embodiment.

DETAILED DESCRIPTION OF THE PREFERRED EMBODIMENTS

Below, modes for implementing the invention (hereafter, these are called embodiments) are explained in detail using drawings.

1. First Embodiment

1-1. Overall Configuration of the Image Forming Apparatus

Figure 1:
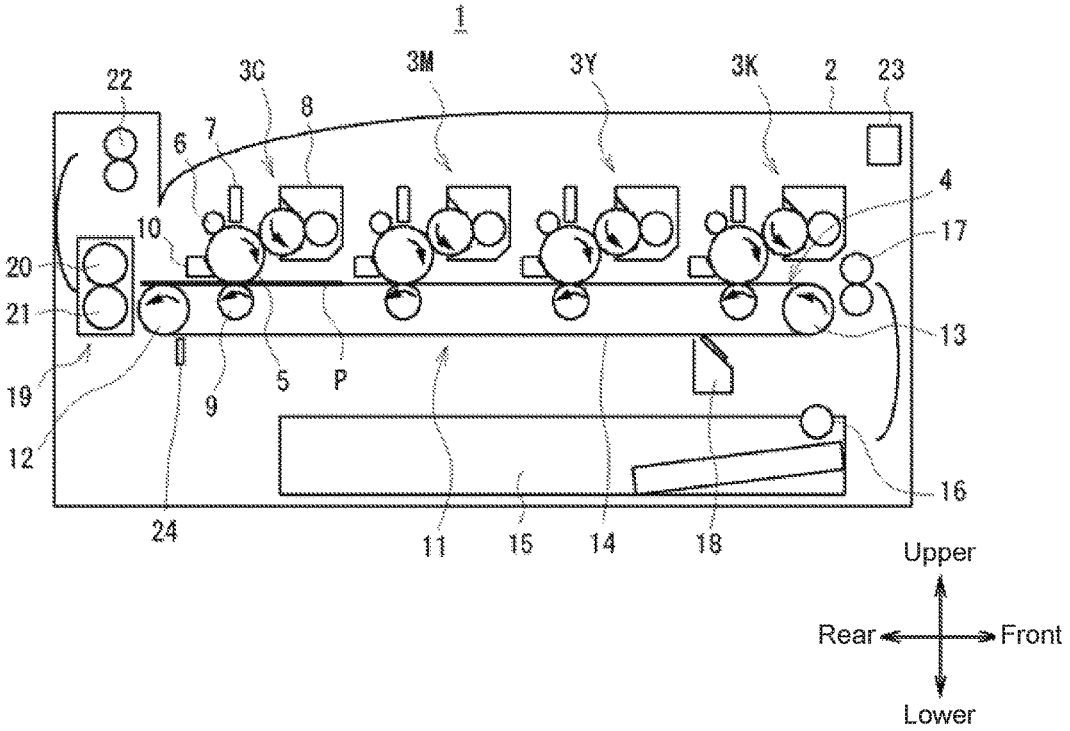
FIG. 1 is a diagram showing the overall configuration of an image forming apparatus by the first embodiment.

Shown in FIG. 1 is the schematic overall configuration of an image forming apparatus 1 in the first embodiment. The image forming apparatus 1 is an electrophotographic printer that prints an image on a sheet P according to a print instruction received from a host device such as an unshown PC (personal computer). This image forming apparatus 1 has an apparatus chassis 2 of an approximate box shape. Note that by regarding the right side in the figure of the apparatus chassis 2 as the front face and the left side in the figure as the back face, the direction from the front face to the back face of the apparatus chassis 2 is regarded as the backward direction, the direction from the back face to the front face as the forward direction, the direction from the lower side to the upper side of the apparatus chassis 2 as the upward direction, the direction from the upper side to the lower side of the chassis 2 as the downward direction, the direction from the near side to the far side in the figure of the apparatus chassis 2 as the rightward direction, and the direction from the far side to the near side in the figure of the apparatus chassis 2 as the leftward direction.

Inside the apparatus chassis 2, in its upper part, four development units 3 (3K, 3Y, 3M and 3C) corresponding to individual toners of multiple colors (e.g., toners of four colors of black (K), yellow (Y), magenta (M), and cyan (C)) are arranged in the front-back direction along a carrying route 4 of the sheet P. Attached to the four development units 3K, 3Y, 3M, and 3C are toner cartridges (omitted in the figure) accommodating the individual color toners to be supplied to the development units 3K, 3Y, 3M, and 3C. Note that an external additive is presumably contained in each of the color toners.

The four development units 3K, 3Y, 3M, and 3C have the same configuration, each of them having a photosensitive drum 5, and a charging roller 6, an LED head 7, a development unit 8, a transfer roller 9, and a cleaning device 10 disposed around the photosensitive drum 5. The details of the configuration of the development units 3K, 3Y, 3M, and 3C are mentioned below.

Furthermore, provided below the development units 3K, 3Y, 3M, and 3C is a transfer part 11 that transfers toner images formed by the development units 3K, 3Y, 3M, and 3C to the sheet P. The transfer part 11 has a drive roller 12 and an idle roller 13, and an annular transfer belt 14 that is stretched by them and extends in the front-back direction along the carrying route 4. The drive roller 12 is a roller to run the transfer belt 14, and the idle roller 13 is a roller to stabilize the running of the transfer belt 14. The transfer belt 14 has its part running on the upper side pass between the photosensitive drum 5 and the transfer roller 9 of each of the development units 3K, 3Y, 3M, and 3C.

Furthermore, provided under the transfer part 11 is a sheet tray 15 to accommodate pieces of the sheet P. A piece of the sheet P at a time is forwarded to the carrying route 4 by a hopping roller 16 from this sheet tray 15 and carried to the transfer part 11 with its skew corrected by a pair of registration rollers 17 disposed opposing each other via the carrying route 4. The sheet P is carried by the transfer belt 14, and when it passes between the photosensitive drum 5 and the transfer roller 9 of each of the development units 3K, 3Y, 3M, and 3C, a toner image of the respective color formed on the photosensitive drum 5 is transferred.

Furthermore, provided in the vicinity of part of the transfer belt 14 running on the lower side is a belt cleaning device 18 to clean the transfer belt 14. Furthermore, provided in the downstream side (back) of the transfer part 11 is a fuser 19 to fuse the toner images transferred to the sheet P by applying heat and a pressure. The fuser 19 has a heat application roller 20 and a pressure application roller 21. The heat application roller 20 has, for example, an elastic layer of silicone rubber provided on an iron raw pipe of 28 mm in outer diameter, and a toner peeling layer made of a PFA tube provided covering this elastic layer for example. This heat application roller 20 has a heat source such as a halogen lamp inside the raw pipe. On the other hand, the pressure application roller 21 has a PFA tube provided on an iron raw pipe.

Furthermore, provided in the downstream side of (above) the fuser 19 is a pair of ejection rollers 22 disposed opposing each other via the carrying route 4 for ejecting the sheet P to the outside of the apparatus chassis 2. Also, inside the apparatus chassis 2, in a position (such as the upper front end part) that is hard to be influenced by heat generated by the fuser 19, a temperature and humidity sensor 23 is provided. This temperature and humidity sensor 23 is a sensor to measure temperature and humidity around the image forming apparatus 1 (i.e., ambient temperature and ambient humidity). Furthermore, inside the apparatus chassis 2, in the vicinity of the back end (the fuser 19 side end) of the transfer belt 14, an internal temperature sensor 24 to measure the internal temperature of the apparatus chassis 2 is provided.

Figure 2:
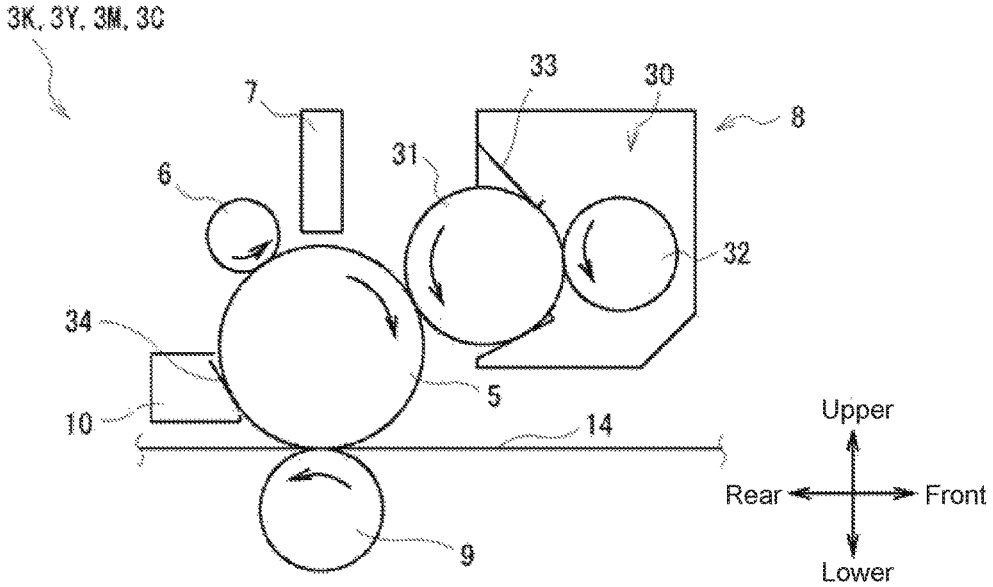
FIG. 2 is a diagram showing the configuration of a development unit by the first embodiment.

The schematic overall configuration of the image forming apparatus 1 is as mentioned above. Here, the configuration of the development units 3K, 3Y, 3M, and 3C is explained in more detail using FIG. 2. As mentioned above, each of the development units 3K, 3Y, 3M, and 3C has the photosensitive drum 5, and the charging roller 6, the LED head 7, the development unit 8, the transfer roller 9, and the cleaning device 10 disposed around the photosensitive drum 5.

The photosensitive drum 5 has, for example, a charge generation layer of 0.5 μm in film thickness and a charge transportation layer of 20 μm in film thickness laminated on an aluminum raw pipe of 0.75 mm in thickness and 30 mm in outer diameter. The charging roller 6 is a roller that uniformly charges the surface of the photosensitive drum 5, and is disposed so as to be in contact with the photosensitive drum 5. This charging roller 6 has, for example, a conductive elastic layer made of epichlorohydrin etc. on a conductor made of SUS material.

The LED head 7 is an exposure device for forming a latent image pattern by selectively exposing the surface of the uniformly-charged photosensitive drum 5, and has LED elements, LED drive elements, and a lens array for example. This LED head 7 is disposed so that irradiation light from the LED elements forms an image on the surface of the photosensitive drum 5.

The development unit 8 is a device for forming a toner image by developing with toner the latent image pattern formed on the photosensitive drum 5, and has a toner accommodation part 30, a development roller 31, a supply roller 32, and a regulation blade 33. This development unit 8 is disposed so that the development roller 31 comes into contact with the photosensitive drum 5, and toner is supplied to the toner accommodation part 30 from a toner cartridge (omitted in the figure).

The development roller 31 is a roller to develop the electrostatic latent image formed on the photosensitive drum 5 by having toner adhere to it, and is made by providing a conductive shaft (metal core) made of SUS material with an elastic layer in a roll shape on it and a surface layer covering this elastic layer for example. As the elastic layer of the development roller 31, for example, urethane rubber or silicone rubber is used, and as the surface layer, for example, surface treatment with a urethane solution or coating with an acrylic resin or an acryl-fluorine copolymer resin is used. Note that if an acrylic resin or an acryl-fluorine copolymer resin is used as the surface layer, in order to provide conductivity, carbon black is mixed for example.

The supply roller 32 is a roller to supply toner accommodated in the toner accommodation part 30 to the development roller 31, and is disposed so as to be in contact with the development roller 31. This supply roller 32 is made by providing a conductive shaft (metal core) made of SUS material with an elastic layer on it for example. The elastic layer of the supply roller 32 is, for example, a conductive silicone rubber foam layer or a conductive urethane rubber foam layer. Note that if this elastic layer should be given semiconductivity, for example, acetylene black, carbon black, or the like is added.

The regulation blade 33 is a blade to make the film thickness of toner on the development roller 31 uniform, and is disposed so as to press its tip part onto the development roller 31. This regulation blade 33 is, for example, made of SUS of 0.08 mm in plate thickness, and its part in contact with the development roller 31 is made a bent part with a bending process applied. Also, the bent part of this regulation blade 33 has, for example, a curvature radius R of 0.2 mm, and a linear pressure of 30 gf/cm to the development roller 31. Note that these values of the curvature radius R and the linear pressure are examples, and the curvature radius R and the linear pressure of the regulation blade 33 can be adjusted according to the amount of toner on the development blade 31 and/or the toner charge amount.

The transfer roller 9 is a roller for transferring a toner image formed on the photosensitive drum 5 to the sheet P, and is disposed opposing the photosensitive drum 5 via the transfer belt 14. As this transfer roller 9, for example, a conductive foamed elastic body is used.

The cleaning device 10 is a device to scrape off and discard toner that was not transferred to the sheet P and remains on the photosensitive drum 5, etc. This cleaning device 10 has a cleaning blade 34 made of rubber for example, and is disposed so as to press the tip part of this cleaning blade 34 onto the surface of the photosensitive drum 5.

The detailed configuration of the development units 3K, 3Y, 3M, and 3C is as mentioned above. Next, the functional blocks of the image forming apparatus 1 are explained using FIG. 3.

1-2. Functional Blocks of the Image Forming Apparatus

Figures 3, 4:
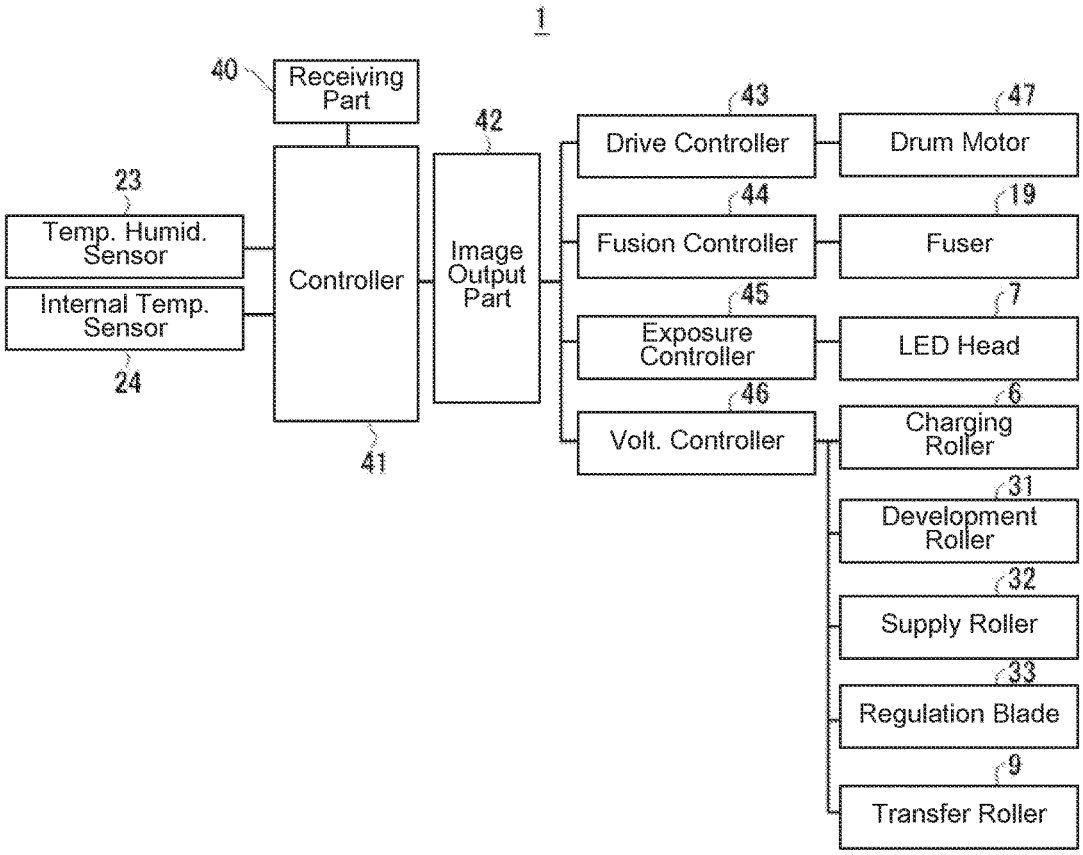
FIG. 3 is a block diagram showing the functional blocks of the image forming apparatus by the first embodiment.
FIG. 4 is a table showing examples of first voltage values and second voltage values set as a charging voltage, a regulating voltage, and a development voltage by the first embodiment.

FIG. 3 is a block diagram showing the functional blocks of the image forming apparatus 1. As the functional blocks, the image forming apparatus 1 has the temperature and humidity sensor 23, the internal temperature sensor 24, a receiving part 40, a controller 41, an image output part 42, a drive controller 43, a fusion controller 44, an exposure controller 45, a voltage controller 46, a drum motor 47, the fuser 19, the LED head 7, the charging roller 6, the development roller 31, the supply roller 32, the regulation blade 33, and the transfer roller 9.

Upon receiving a print job from the unshown host device via the receiving part 40, according to the print instruction of this print job, based on temperature and humidity data output from the temperature and humidity sensor 23, temperature data output from the internal temperature sensor 24, and image data sent as the print job from the host device, the controller 41 issues print operation instructions to the drive controller 43, the fusing controller 44, the exposure controller 45, and the voltage controller 46 via the image output part 42.

The image output part 42 applies conversion and/or other processes as appropriate to the print operation instructions sent from the controller 41 and sends them to the drive controller 43, the fusion controller 44, the exposure controller 45, and the voltage controller 46, respectively. The fusion controller 44 controls temperature of the fuser 19 according to the print operation instruction. The exposure controller 45 controls light emission of the LED head 7 according to the print operation instruction. The voltage controller 46 controls voltages applied to the charging roller 6, the development roller 31, the supply roller 32, the regulation blade 33, and the transfer roller 9 according to the print operation instructions, respectively. The drive controller 43 controls the driving of the drum motor 47 according to the print operation instruction.

The voltage controller 46 applies voltages to the charging roller 6, development roller 31, the supply roller 32, the regulation blade 33 and transfer roller 9 based on a frame ground of a conductive metal that the apparatus chassis 2. In the photosensitive drum, an aluminum bare pipe, which is a base, is electrically connected to the frame ground. The frame ground is grounded using a ground wire that an AC code has.

The drum motor 47 supplies a driving force to each of the development units 3K, 3Y, 3M, and 3C through a drive shaft. Each of the development units 3K, 3Y, 3M, and 3C has a gear (not shown) to connect to the drive shaft, and a gear (not shown) for transmitting the driving force supplied from the drum motor 47 to the photosensitive drum 5, the development roller 31, and the supply roller 32 through this gear. By rotating the drum motor 47 in one direction (this is called forward rotation), the drive controller 43 can forward-rotate the photosensitive drum 5, the development roller 31, and the supply roller 32 in the direction indicated with an arrow in FIG. 2, and by rotating the drum motor 47 in the other direction (this is called reverse rotation), it can reverse-rotate the photosensitive drum 5, the development roller 31, and the supply roller 32 in the direction opposite to the direction indicated with the arrow in FIG. 2. The functional blocks of the image forming apparatus 1 are as mentioned above.

Note that although the image forming apparatus 1 is also provided with, other than the drum motor 47, a motor to drive the drive roller 12 of the transfer part 11, a motor to drive the hopping roller 16, the registration roller 17, the pair of ejection rollers 22, etc., a motor to drive the heat application roller 20 of the fuser 19, etc., explanations on these are omitted.

1-3. Operation of the Image Forming Apparatus

Next, the operation of the image forming apparatus 1 is explained. In the image forming apparatus 1, one a print job is received from the host device, the controller 41 issues print operation instructions to the drive controller 43, the fusion controller 44, the exposure controller 45, and the voltage controller 46 through the image output part 42. Then, by forward-rotating the drum motor 47, the drive controller 43 forward-rotates the photosensitive drum 5, the development roller 31, and the supply roller 32 of each of the development units 3K, 3Y, 3M, and 3C in the direction indicated with the arrow in FIG. 2. At this time, by co-rotating with the photosensitive drum 5, the charging roller 6 also forward-rotates in the direction indicated with the arrow in FIG. 2. Furthermore, by the voltage controller 46 applying a prescribed charging voltage to the charging roller 6, the surface of the photosensitive drum 5 in contact with the charging roller 6 is uniformly charged. Afterwards, by the exposure controller 45 having the LED head 7 emit light, an electrostatic latent image pattern is formed on the surface of the photosensitive drum 5. On the other hand, the voltage controller 46 applies a prescribed supply voltage to the supply roller 32, a prescribed development voltage to the development roller 31, and further a prescribed regulating voltage to the regulation blade 33. Thereby, toner is supplied from the supply roller 32 to the development roller 31, a toner thin layer on the development roller 31 is uniformly formed by the regulation blade 33, and toner in the toner thin layer is charged by a prescribed charge amount.

Then, the electrostatic latent image pattern formed on the photosensitive drum 5 is developed with the toner on the development roller 31, forming a toner image. Furthermore, the voltage controller 46 applies a prescribed transfer voltage to the transfer roller 9. Thereby, the toner image formed on the photosensitive drum 5 is transferred onto the sheet P carried up by the transfer belt 14. Afterwards, the image forming apparatus 1 has the toner image transferred onto the sheet P fused to the sheet P by the fuser 19, and ejects this sheet P by the pair of ejection rollers 22 to the outside of the apparatus chassis 2, thereby completing the print operation for one page. Here, the toner that was not transferred and remains on the photosensitive drum 5 is removed by the cleaning device 10. Note that if the print job includes image data for multiple pages, the image forming apparatus 1 repeats such print operation as this for the multiple pages.

In addition, in order to remove foreign bodies stuffed in the contact place between the development roller 31 and the regulation blade 33, after completing the print operation of the print job, the image forming apparatus 1 of this embodiment performs an operation to forward-rotate the development roller 31 for a prescribed length of time (or prescribed period) in a state where the magnitude relationship between the regulating voltage applied to the regulation blade 33 and the development voltage applied to the development roller 31 of each of the development units 3K, 3Y, 3M, and 3C, and afterwards performs an operation to reverse-rotate the development roller 31 for a prescribed period (this is called foreign body removal operation). Note that this foreign body removal operation is performed by the controller 41 issuing foreign body removal operation instructions to the drive controller 43 and the voltage controller 46 via the image output part 42.

Here, the values of the charging voltage (a voltage applied to the charging roller 6), the regulating voltage, and the development voltage applied during the print operation are called first voltage values, and their values applied when changing over to the foreign body removal operation are called second voltage values. The first voltage values and the second voltage values of these charging voltage, regulating voltage, and development voltage are shown in FIG. 4.

As shown in this FIG. 4, in the image forming apparatus 1, the charging voltage, the regulating voltage, and the development voltage have their first voltage values set to −1000 V, −200 V, and −150 V, respectively, and the second voltage values set to −950 V, −100 V, and −200 V, respectively. Note that the first voltage values and the second voltage values shown in FIG. 4 are examples and can be made adjustable as appropriate instead of being fixed values. For example, it can be arranged so that the voltage controller 46 adjusts the first voltage values and the second voltage values according to temperature and humidity data sent from the controller 41 (i.e., according to at least one of temperature and humidity detected by the temperature and humidity sensor 23). In this case, for example, a table that has the first voltage values and the second voltage values in correspondence with ambient temperature and ambient humidity can be stored in a memory part (not shown), and the voltage controller 46 can acquire the first voltage value and the second voltage value corresponding to temperature and humidity from this table. In fact, the charging characteristic etc. of toner vary according to temperature and humidity. Because of this, if the first voltage values and the second voltage values of the charging voltage, the regulating voltage, and the development voltage are adjusted according to temperature and humidity detected by the temperature and humidity sensor 23, image quality can be maintained at a constant level.

The regulating voltage and the development voltage are set so that the magnitude relationship between the first voltage value and the second voltage value is reversed (so that the relationship of the regulating voltage<the development voltage becomes the relationship of the regulating voltage>the development voltage). That is, in the image forming apparatus 1, the print operation of a print job is performed in a state where the regulating voltage and the development voltage are set to the first voltages, and during the foreign body removal operation later, the development roller 31 is forward-rotated for the prescribed period with the regulating voltage and the development voltage changed to the second voltage values.

To explain more specifically, the image forming apparatus applies the regulating voltage of −200 V to the regulation blade 33 and also applies the development voltage of −150 V to the development roller 31 by the voltage controller 46. At this time, in the vicinity of the contact place between the regulation blade 33 and the development roller 31, negatively-charged toner is drawn toward the development roller 31 charged positively relative to the regulation blade 33. Then, the toner adsorbed on the surface of the development roller 31 is converted into a thin layer when passing between the development roller 31 and the regulation blade 33.

As opposed to this, during the foreign body removal operation, the image forming apparatus 1 reverses the magnitude relationship between the regulating voltage and the development voltage by applying the regulating voltage of −100 V to the regulation blade 33 and also apply the development voltage of −200 V to the development roller 31 by the voltage controller 46. At this time, in the vicinity of the contact place between the regulation blade 33 and the development roller 31, negatively-charged toner is drawn toward the regulation blade 33 charged positively relative to the development roller 31. Therefore, the amount of toner that returns to the toner accommodation part 30 without passing between the development roller 31 and the regulation blade 33 becomes greater than that during the print operation. That is, if the magnitude relationship between the regulating voltage and the development voltage is reversed, the regulating force of the regulation blade 33 becomes greater than that during the print operation.

Figure 5:
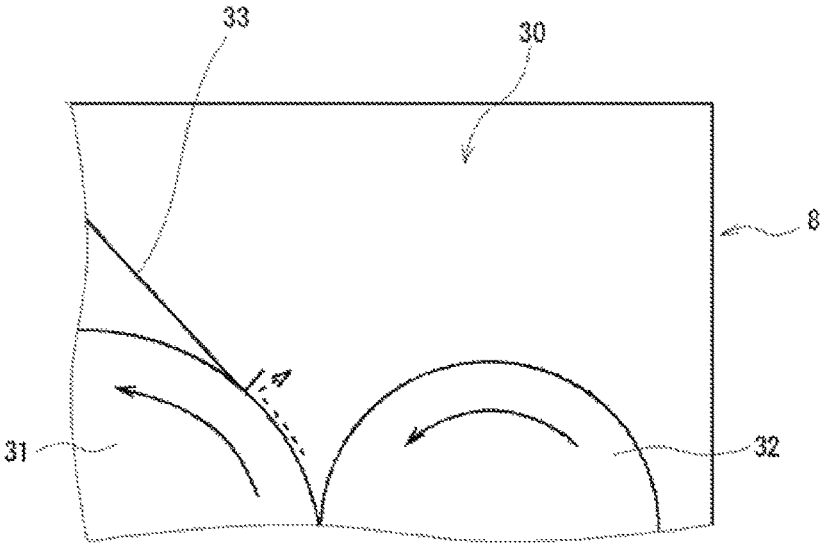
FIG. 5 is a diagram showing a flow of toner returning from the contact place between the development roller and the regulation blade to a toner accommodating chamber by the first embodiment.

Thereby, in the vicinity of the contact place between the regulation blade 33 and the development roller 31, as indicated with a dotted arrow in FIG. 5, the flow of toner returning from the contact place to the toner accommodation part 30 becomes greater than that during the print operation, and by this kind of toner flow, softly-aggregated toner and its external additive stuffed in the contact place become easy to move (i.e., it becomes easy to move them to the toner accommodation part 30).

Upon making it easy to move softly-aggregated toner and its external additive stuffed in the contact place between the regulation blade 33 and the development roller 31 in this manner, the image forming apparatus 1 reverse-rotates the development roller 31. Thereby, the image forming apparatus 1 can move also the softly-aggregated toner and its external additive stuffed in the contact place between the regulation blade 33 and the development roller 31, together with shavings of the supply roller 32 etc., to the toner accommodation part 30, removing them from the contact place.

Also, in the image forming apparatus 1, during the foreign body removal operation, along with changing the regulating voltage and the development voltage from the first voltage values to the second voltage values, the charging voltage is also changed from the first voltage value to the second voltage value. This is for suppressing toner discharge due to a fogging phenomenon that low-charge toner and oppositely-charged (i.e., positively-charged) toner migrate from the development roller 31 to part of the photosensitive drum 5 that is not exposed (this is called unexposed part). Note that toner discharge means that toner adheres to the unexposed part of the photosensitive drum 5 and is uselessly consumed.

To explain specifically, once the regulating voltage and the development voltage are changed from the first voltage values to the second voltage values, the absolute value of the regulating voltage (200→100) becomes smaller than the absolute value of the development voltage (150→200), reducing the toner charge amount. Once the toner charge amount decreases, the amount of toner that migrates from the development roller 31 to the unexposed part of the photosensitive drum 5 could increase.

Then, in the image forming apparatus 1, when the regulating voltage and the development voltage are changed from the first voltage values to the second voltage values, the charging voltage is changed from the first voltage value (−1000 V) to the second voltage value (−950 V) that is smaller than this first voltage value in the absolute value. In this manner, once the absolute value of the charging voltage is decreased, the difference between the development voltage and the charging voltage decreases, and the absolute value of electric potential of the unexposed part of the photosensitive drum 5 decreases, thereby making it hard for low-charge toner and oppositely-charged toner to migrate to the unexposed part. As the result, toner discharge due to the fogging phenomenon is suppressed.

In this manner, the image forming apparatus 1 can remove foreign bodies (softly-aggregated toner and its external additive, shavings of the supply roller 32, etc.) stuffed in the contact place between the development roller 31 and the regulation blade 33 while suppressing toner discharge due to the fogging phenomenon by changing the charging voltage, the regulating voltage, and the development voltage from the first voltage values to the second voltage values, continuing to forward-rotate the development roller 31 for the prescribed period, and afterwards reverse-rotating the development roller 31 for the prescribed period during the foreign body removal operation.

Note that this foreign body removal operation is performed, for example, simultaneously in the development units 3K, 3Y, 3M, and 3C.

Figure 6:
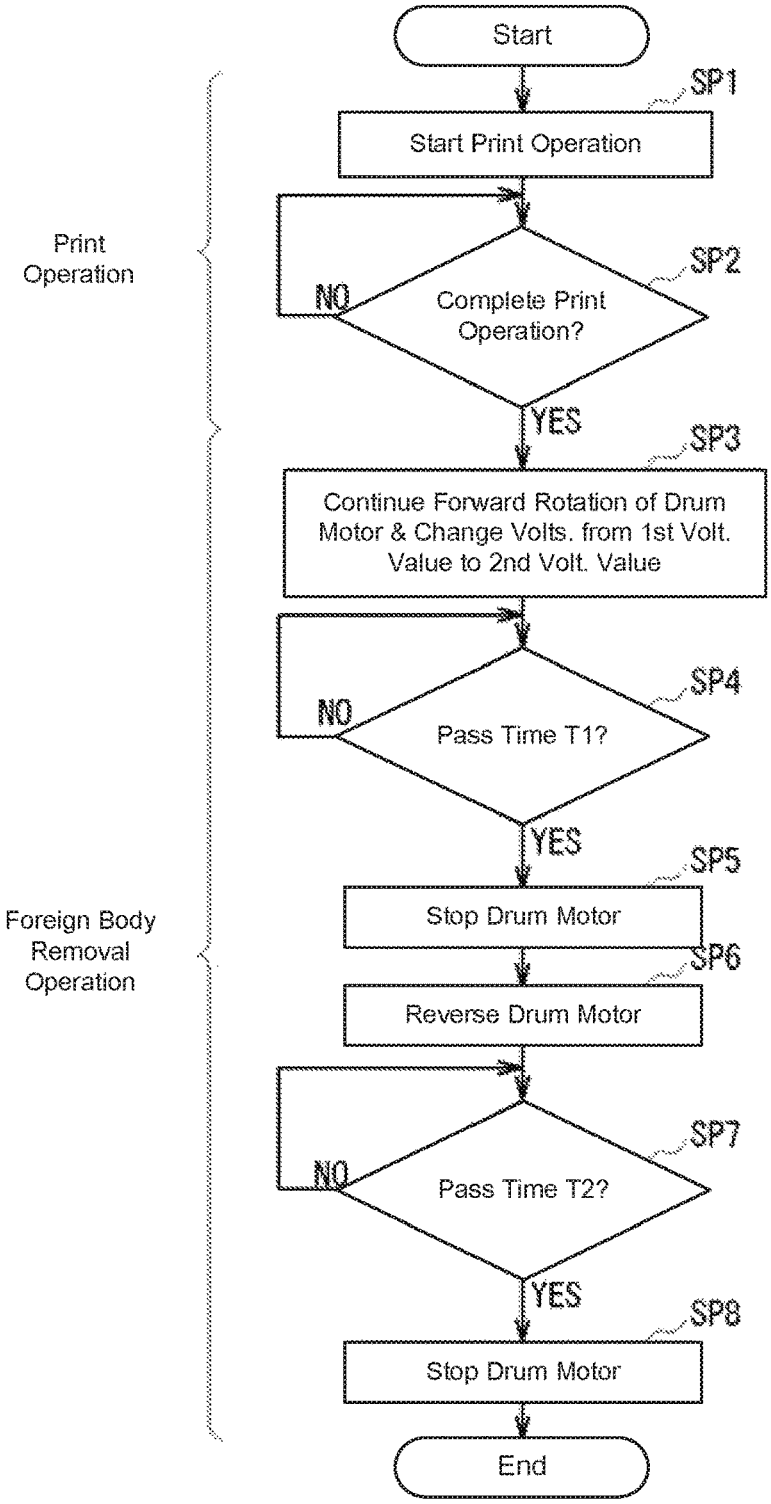
FIG. 6 is a flow chart showing the control procedures of a charging roller, the development roller, and the regulation blade during a print operation and during a foreign body removal operation by the first embodiment.
Figures 7, 8:
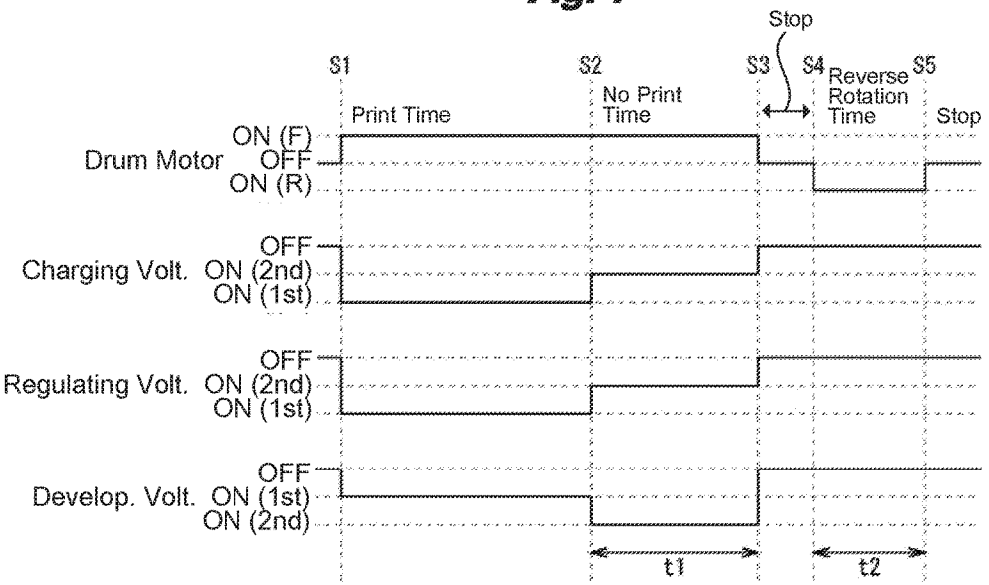
FIG. 7 is a timing chart showing the control timings of the charging roller, the development roller, and the regulation blade during the print operation and during the foreign body removal operation by the first embodiment.
FIG. 8 is a table showing experimental results by the first embodiment.

Here, the controls of the charging roller 6, the development roller 31, and the regulation blade 33 during the print operation and during the foreign body removal operation are explained in detail using a flow chart shown in FIG. 6 and a timing chart shown in FIG. 7.

Upon receiving a print job from the host device, in SP1 the controller 41 of the image forming apparatus 1 issues instructions of the print operation to the drive controller 43, the fusion controller 44, the exposure controller 45, and the voltage controller 46 through the image output part 42.

According to the print operation instruction, at a print start point of time S1 shown in FIG. 7 the drive controller 43 forward-rotates the drum motor 47 to forward-rotate the photosensitive drum 5, the development roller 31, and the supply roller 32. At this time, the charging roller 6 also forward-rotates by co-rotating with the photosensitive drum 5. Also, according to the print operation instruction, at the print start point of time S1 the voltage controller 46 sets the values of the charging voltage, the regulating voltage, and the development voltage to the first voltage values, and applies them to the charging roller 6, the regulation blade 33, and the development roller 31. In this manner, the image forming apparatus 1 starts printing to the sheet P.

In the subsequent SP2 the controller 41 waits for the completion of printing of the print job, and once the printing is complete, moves to SP3 and issues instructions of the foreign body removal operation to the drive controller 43 and the voltage controller 46 through the image output part 42. Specifically, the controller 41 instructs the drive controller 43 to continue forward-rotating the drum motor 47. Also, at this time, the controller 41 instructs the voltage controller 46 to change the charging voltage, the regulating voltage, and the development voltage applied respectively to the charging roller 6, the regulation blade 33, and the development roller 31 from the first voltage values to the second voltage values. Thereby, as shown in FIG. 7, the drive controller 43 continues forward-rotating the drum motor 47 even after a print completion point of time S2, and the voltage controller 46 applies the charging voltage, the regulating voltage, and the development voltage of the second voltage values to the charging roller 6, the regulation blade 33, and the development roller 31, respectively, after the print completion point of time S2.

Afterwards, in SP4 (FIG. 6) the controller 41 waits until time t1 passes, and once the time t1 has passed, moves to the subsequent SP5 and instructs the drive controller 43 to stop the drum motor 47 through the image output part 42. Also, at this time, the controller 41 instructs the voltage controller 46 to stop applying voltages to the charging roller 6, the regulation blade 33, and the development roller 31. Thereby, as shown in FIG. 7, at a point of time S3 when the time t1 has passed since the print completion point of time S2, the drive controller 43 stops the drum motor 47, and the voltage controller 46 stops applying voltages to the charging roller 6, the regulation blade 33, and the development roller 31 to turn off the charging voltage, the regulating voltage, and the development voltage.

In this manner, until the time t1 has passed since the print completion point of time S2 when printing of the print job is completed, the controller 41 continues forward-rotating the development roller 31 with the charging voltage, the regulating voltage, and the development voltage changed from the first voltage values to the second voltage values. Note that the time t1 is 1 second for example, the rotation speed (linear velocity of the surface) of the photosensitive drum 5 during the forward rotation is 160 mm/s for example, and the rotation speed (linear velocity of the surface) of the development roller 31 during the forward rotation is set to about 1.2 times the rotation speed of the photosensitive drum 5. Note that the rotation speed of the development roller 31 at this time is an example and can also be set to a value outside the range of 1.2-1.4 times the rotation speed of the photosensitive drum 5.

Afterwards, in SP6 the controller 41 instructs the drive controller 43 through the image output part 42 to reverse-rotate the drum motor 47. Thereby, as shown in FIG. 7, at a point of time S4, the drive controller 43 reverse-rotates the drum motor 47. As the result, the development roller 31 reverse-rotates.

Afterwards, in SP7 the controller 41 waits until time t2 passes, and once the time t2 has passed, moves to the subsequent SP8 and instructs the drive controller 43 through the image output part 42 to stop the drum motor 47. Thereby, as shown in FIG. 7, at a point of time S5 when the time t2 has passed since the point of time S4, the drive controller 43 stops the drum motor 47. At this point of time S5, the foreign body removal operation ends.

In this manner, until the time t2 passes after the point of time S4, the controller 41 continues reverse-rotating the development roller 31. Note that the time t2 is 40 milliseconds for example, the rotation speed of the photosensitive drum 5 during the reverse rotation is 46 mm/s for example, and the rotation speed of the development roller 31 during the reverse rotation is set to about 1.2 times (1.2-1.4 times) the rotation speed of the photosensitive drum 5. Note that the rotation speed of the development roller 31 at this time is also an example and can also be set to a value outside the range of 1.2-1.4 times the rotation speed of the photosensitive drum 5.

Also, the rotation speeds of the photosensitive drum 5 and the development roller 31 during the reverse rotation are set to the lowest settable speeds during the print operation (i.e., the lowest settable speeds during the forward rotation). The reason is that when reverse-rotating the photosensitive drum 5 and the development roller 31, their rotation amounts need to be accurately controlled. In fact, if the reverse rotation amount is too small, foreign bodies stuffed in the contact place between the development roller 31 and the regulation blade 33 cannot be sufficiently removed, and if the reverse rotation amount is too large, toner leaks from the development unit 8 to the transfer part 11. Therefore, by reverse-rotating the photosensitive drum 5 and the development roller 31 at the lowest settable speeds, the image forming apparatus 1 can sufficiently remove foreign bodies stuffed in the contact place between the development roller 31 and the regulation blade 33 while preventing toner from leaking.

Note that in the image forming apparatus 1, although the time t1 for the forward rotation of the drum motor 47 during the foreign body removal operation is set to 1 second, and the time t2 for the reverse rotation to 40 milliseconds, these time t1 and time t2 can be changed as appropriate. Incidentally, in the image forming apparatus 1, the time t1 was set to 1 second, and the time t2 to 40 milliseconds so that foreign bodies could be sufficiently removed by the foreign body removal operation, and the foreign body removal operation be completed in as short time as possible.

Also, in the image forming apparatus 1, although the rotation speed for the forward rotation of the photosensitive drum 5 during the foreign body removal operation is set to 160 mm/s, and the rotation speed for the reverse rotation to 46 mm/s, these can also be changed as appropriate.

1-4. Summary and Efficacy

As explained above, in the image forming apparatus 1 of the first embodiment, after completing the print operation of a print job, the development roller 31 is kept forward-rotating in a state where the magnitude relationship between the regulating voltage and the development voltage is reversed from that during the print operation by changing the regulating voltage and the development voltage from the first voltage values to the second voltage values. By doing so, in the vicinity of the contact place between the regulation blade 33 and the development roller 31, a toner flow returning from the contact place to the toner accommodation part 30 becomes larger than that during the print operation, and by this flow, soft-aggregated toner and its external additive stuffed in the contact place become easy to move (i.e., easy to be removed).

Then, the image forming apparatus 1 keeps the development roller 31 reverse-rotating for the prescribed period. By doing so, the image forming apparatus 1 can also remove soft-aggregated toner and its external additive stuffed in the contact place between the regulation blade 33 and the development roller 31 together with shavings of the supply roller 32 etc. from the contact place.

Furthermore, along with changing the regulating voltage and the development voltage from the first voltage values to the second voltage values, the image forming apparatus 1 also changes the charging voltage from the first voltage value to the second voltage value. That is, in accordance with the fact that the toner charge amount decreases by changing the regulating voltage and the development voltage from the first voltage values to the second voltage values, the image forming apparatus 1 changes the charging voltage from the first voltage value to the second voltage value that is smaller than the first voltage value in the absolute value. By doing so, the image forming apparatus 1 can make it hard for low-charge toner and oppositely-charged toner to migrate to the unexposed part of the photosensitive drum 5 and suppress toner discharge due to the fogging phenomenon.

Furthermore, the image forming apparatus 1 sets the rotation speeds of the photosensitive drum 5 and the development roller 31 for reverse-rotating the development roller 31 to the lowest settable speeds during the forward rotation. By doing so, the image forming apparatus 1 can accurately control the rotation amounts of the photosensitive drum 5 and the development roller 31 and sufficiently remove foreign bodies stuffed in the contact place between the development roller 31 and the regulation blade 33 while preventing toner from leaking.

By the way, if foreign bodies remain stuffed in the contact place between the development roller 31 and the regulation blade 33, part of the toner thin layer formed on the development roller 31 becomes extremely thin for example, causing print defects such as generating white streaks on the image transferred to the sheet P.

Therefore, by removing foreign bodies stuffed in the contact place between the development roller 31 and the regulation blade 33, the image forming apparatus 1 can also suppress print defects such as white streaks.

Here, shown in a table in FIG. 8 are experimental results of verifying the occurrences of print defects by actually performing printing using each of the image forming apparatus 1 of this embodiment, an image forming apparatus that reverse-rotates the development roller without changing the voltages (the charging voltage, the regulating voltage, and the development voltage) after completing the print operation (this is called the first comparison target apparatus), and an image forming apparatus that does not change the voltages or reverse-rotate the development roller after completing the print operation (this is called the second comparison target apparatus).

As shown in this table, in the second comparison target apparatus, print defects occurred by the time 10000 pieces of sheet P were printed. Also, in the first comparison target apparatus, print defects occurred by the time between 20000 pieces and 30000 pieces of sheet P were printed. As opposed to this, in the image forming apparatus 1 of this embodiment, no print defect occurred by the time 30000 pieces of sheet P were printed. Because printing 30000 pieces is the lifetime of the development unit 8, this practically signifies no print defect occurs in the image forming apparatus 1.

As is evident from these experimental results, compared with conventional image forming apparatuses such as the first comparison target apparatus and the second comparison target apparatus, the image forming apparatus 1 could suppress print defects. Based on this also, it can be said that the image forming apparatus 1 can sufficiently remove foreign bodies stuffed in the contact place between the development roller 31 and the regulation blade 33 so that no print defect occurs.

Note that although the image forming apparatus 1 of the first embodiment executes the foreign body removal operation every time the print operation of a print job is completed, this invention is not limited to this, but the foreign body removal operation can be executed, for example, at prescribed timing such as at every prescribed print piece number.

2. Second Embodiment

Next, the second embodiment is explained. This second embodiment is different from the first embodiment in the timing to execute the foreign body removal operation.

2-1. Functional Blocks of the Image Forming Apparatus

Figure 9:
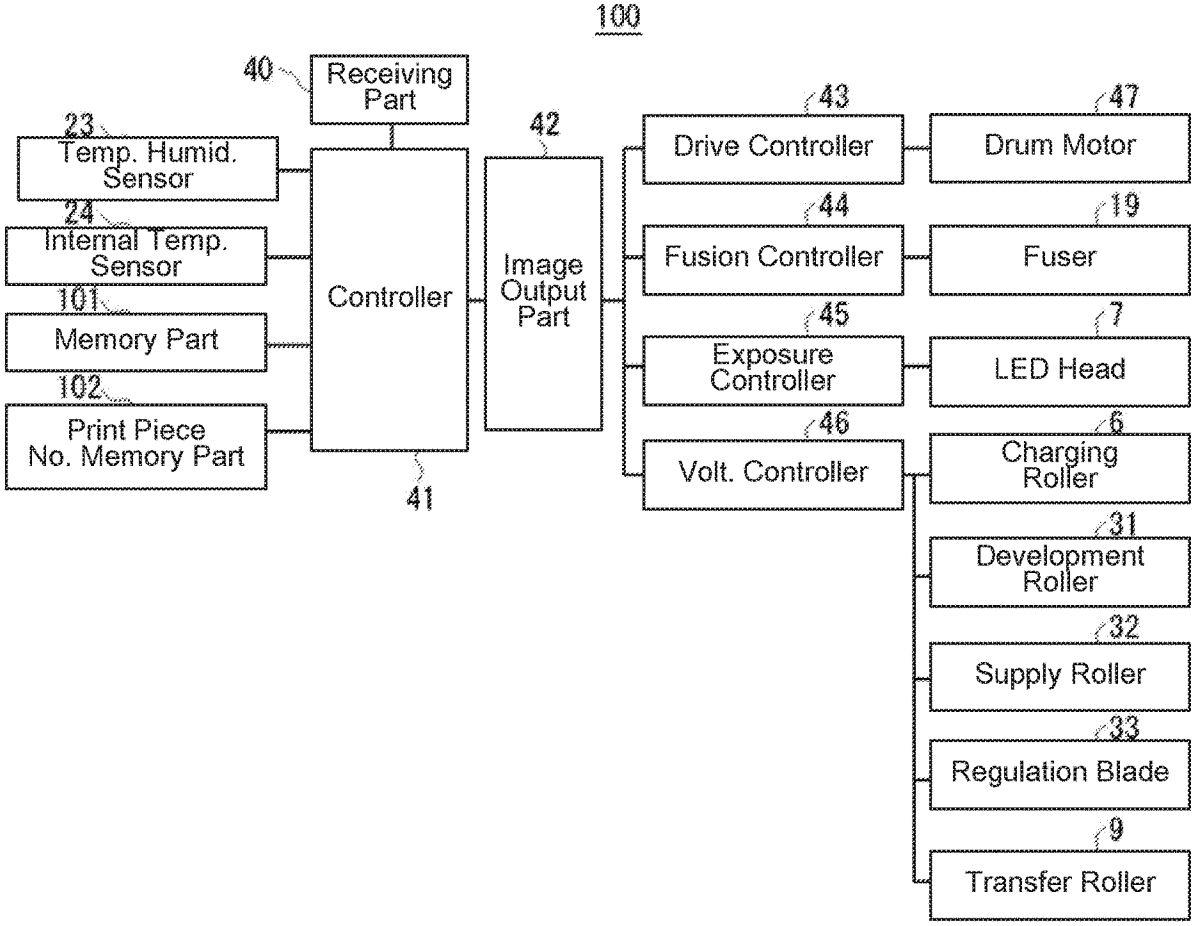
FIG. 9 is a block diagram showing the functional blocks of an image forming apparatus by the second embodiment.

First of all, using FIG. 9, the functional blocks of an image forming apparatus 100 in the second embodiment are explained. Note that because the overall configuration of the image forming apparatus 100 is the same as that of the image forming apparatus 1 of the first embodiment, its detailed explanation is omitted.

The functional blocks of the image forming apparatus 100 are those of the image forming apparatus 1 (FIG. 3) with a memory part 101 and a print piece number memory part 102 added, and because the other functional blocks are the same as those of the image forming apparatus 1, their detailed explanations are omitted.

The memory part 101 stores various kinds of tables mentioned below. The print piece number memory part stores the continuous print piece number. The continuous print piece number is the number of pieces (i.e., the number of pieces of the sheet P) when the image forming apparatus 100 continuously performed printing without stopping the operation of the development units 3K, 3Y, 3M, and 3C. This continuous print piece number is counted (incremented) by the controller 41 every time printing onto the sheet P is completed during the continuous print operation. Note that the image forming apparatus 100 occasionally prints multiple print jobs continuously without stopping the operation of the development units 3K, 3Y, 3M, and 3C. In this case, the controller 41 would continue to count the continuous print piece number until printing of the last print job is completed.

Here, shown in FIG. 10 is an environmental table Tb1 stored in the memory part 101. The environmental table Tb1 shows the correspondence between temperature T (° C.) and humidity H (%) measured by the temperature and humidity sensor 23 and an environmental value e indicating the environment around the image forming apparatus 100. The environmental value e is expressed in a numerical value of 1-8 as shown in the environmental table Tb1, and becomes smaller as the temperature T or the humidity H becomes higher, and larger as the temperature T or the humidity H becomes smaller. The controller 41 acquires the current temperature T and humidity H from temperature and humidity data output from the temperature and humidity sensor 23, and acquires the environmental value e corresponding to these temperature T and humidity H from the environmental table Tb1.

The controller 41 of the image forming apparatus 100 performs the foreign body removal operation not only after completing the print operation but also during the continuous print operation, and adjusts the timing (frequency) to execute the foreign body removal operation during the continuous print operation based on the environmental value e and the continuous print piece number.

Specifically, as shown in a table in FIG. 11, the controller 41 executes the foreign body removal operation every time 50 pieces have been printed independently of the environmental value e until the continuous print piece number reaches 200. That is, the execution frequency of the foreign body removal operation at this time is 50 pieces.

On the other hand, after the number of continuously-printed pieces had reached 200, the smaller the environmental value e is, the higher the execution frequency of the foreign body removal operation the controller 41 sets. In the example shown in the table in FIG. 11, although when the continuous print piece number is 200 or larger and the environmental value e is 4 or larger, the execution frequency of the foreign body removal operation remains 50 pieces, when the environmental value e is 3 or smaller, the smaller the environmental value e is, the higher the execution frequency of the foreign body removal operation becomes, such as at every 45 pieces, every 40 pieces, or every 35 pieces.

In this manner, when the continuous print piece number is 200 or larger and the environmental value e is 3 or smaller (i.e., in the case of a high-temperature and high-humidity environment where the temperature T is about 20° C. or higher and the humidity is about 30% or higher), the smaller the environmental value e is (i.e., the higher the temperature T or the humidity H is), the higher the execution frequency of the foreign body removal operation is set.

In fact, in the image forming apparatus 100, when continuous printing continues in a high-temperature and high-humidity environment, temperature of the contact place between the development roller 31 and the regulation blade 33 rapidly rises. Then, toner and its external additive existing in the vicinity of the contact place between the development roller 31 and the regulation blade 33 receive damages and become easy to aggregate. As the result, it becomes easy for softly-aggregated toner and its external additive to be stuffed in the contact place between the development roller 31 and the regulation blade 33.

Then, in the image forming apparatus 100 of this embodiment, when continuous printing has continued in a high-temperature and high-humidity environment, even in a situation where softly-aggregated toner and its external additive become easily stuffed in the contact place between the development roller 31 and the regulation blade 33, by increasing the execution frequency of the foreign body removal operation, foreign bodies stuffed in the contact place between the development roller 31 and the regulation blade 33 can be sufficiently removed.

Next, shown in FIG. 12 is a parameter table Tb2 stored in the memory part 101. This parameter table Tb2 shows the correspondence between various kinds of parameters d, a, b, and Z and the environmental parameter e. The parameters d, a, b, and Z are values used for adjusting the execution frequency of the foreign body removal operation.

The parameter d indicates a threshold value of the continuous print piece number. As shown in the parameter table Tb2, this parameter d is constant (e.g., 200) independently of the environmental value e. The parameter Z indicates a standard for the frequency (this is called standard frequency) to execute the foreign body removal operation during continuous printing, and is set as the print piece number. As shown in the parameter table Tb2, this parameter Z is constant (e.g., 50) independently of the environmental value e. That is, in the parameter table Tb2, the standard frequency to perform the foreign body removal operation is set to 50 pieces.

The parameter a and the parameter b are for adjusting the execution frequency of the foreign body removal operation by multiplying them to the parameter Z. As shown in the parameter table Tb2, the parameter a is constant (e.g., 1.0) independently of the environmental value e. On the other hand, as shown in the parameter table Tb2, the parameter b is a value that is constant (e.g., 1.0) when the environmental value e is 4 or larger, and when the environmental value e is 1-3, becomes smaller (0.7-0.9) as the environmental value e becomes smaller.

The controller 41 adjusts the execution frequency of the foreign body removal operation using these parameters d, a, b, and Z based on the environmental value e and the continuous print piece number. The specific method of adjusting the execution frequency is mentioned below.

2-2. Operation of the Image Forming Apparatus

Next, the operation of the image forming apparatus 100 is explained. Because the operation of the image forming apparatus 100 is the same as that of the image forming apparatus 1 except for the fact that the controller 41 executes the foreign body removal operation during the continuous print operation, the detailed explanation on the same part is omitted. That is, during the continuous print operation, the controller 41 of the image forming apparatus 100 executes the foreign body removal operation based on the execution frequency adjusted using the parameters d, a, b, and Z based on the environmental value e and the continuous print piece number. Because the foreign body removal operation itself performed at this time is the same as the foreign body removal operation explained in the first embodiment (the operation in SP3 and later shown in FIG. 6, and the operation at the print completion point of time S2 and later shown in FIG. 7), its detailed explanation is omitted.

Figure 13:
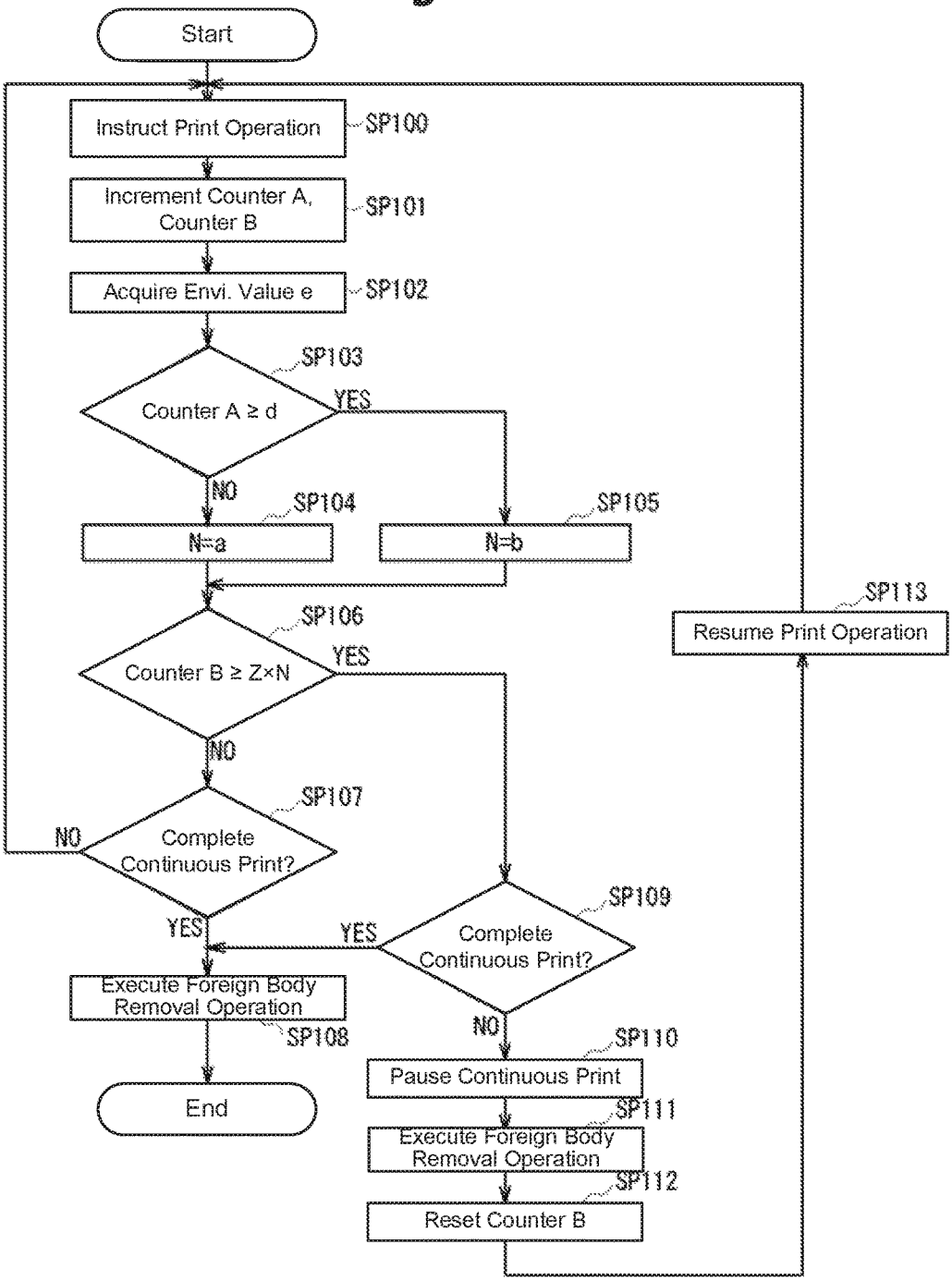
FIG. 13 is a flow chart showing the execution procedure of the foreign body removal operation by the second embodiment.

Here, the procedure to execute the foreign body removal operation during continuous printing is explained in detail using a flow chart shown in FIG. 13.

Upon receiving a print job from the host device, in SP100 the controller 41 of the image forming apparatus 100 issues instructions of the print operation through the image output part 42 to the drive controller 43, the fusion controller 44, the exposure controller 45, and the voltage controller 46.

According to the print operation instruction, the drive controller 43 forward-rotates the drum motor 47 to forward-rotate the photosensitive drum 5, the development roller 31, and the supply roller 32. At this time, the charging roller 6 also forward-rotates by co-rotating with the photosensitive drum 5. Also, according to the print operation instruction, the voltage controller 46 sets the values of the charging voltage, the regulating voltage, and the development voltage to the first voltage values, and applies them to the charging roller 6, the regulation blade 33, and the development roller 31, respectively. In this manner, the image forming apparatus 100 starts printing onto the sheet P.

Once printing for one page is complete (i.e., once printing for one piece of sheet is complete), in the subsequent SP101 the controller 41 increments (+1) a counter A and a counter B. The counter A indicates the continuous print piece number, and its initial value is 0. The counter B indicates the number of pieces printed after the last foreign body removal operation, and its initial value is also 0. Therefore, if printing of the first page is completed by the continuous print operation of this time, both the counter A and the counter B are updated from 0 to 1. These counter A and counter B are stored in the print piece number memory part 102.

In the subsequent SP102 the controller 41 acquires the current temperature T and humidity H from temperature and humidity data output from the temperature and humidity sensor 23, and acquires the environmental value e corresponding to these temperature T and humidity H from the environmental table Tb1.

In the subsequent SP103 the controller 41 acquires the parameters d, a, b, and Z corresponding to the environmental value e from the parameter table Tb2, and judges whether the counter A is no smaller than the parameter d. The parameter d is a threshold value of the continuous print piece number and is set to 200 independently of the environmental value e. Therefore, judging whether the counter A is no smaller than the parameter d signifies judging whether the continuous print piece number up to the present (the counter A) is no smaller than 200 (the parameter d).

If a negative result is obtained in this SP103 because the number of continuously-printed pieces has not reached 200, the controller 41 moves to SP104. In SP104 the controller 41 substitutes the parameter a for a coefficient N to adjust the execution frequency (this is called the frequency adjustment coefficient) and moves to SP106. Here, the frequency adjustment coefficient N is a coefficient to be multiplied to the parameter Z that is the standard frequency for adjusting the execution frequency of the foreign body removal operation within a range of 35-50. As mentioned above, the parameter a is set to 1.0 independently of the environmental value e. Therefore, the frequency adjustment coefficient N=1.0 at this time. In this case, the execution frequency becomes 50×1.0=50.

As opposed to this, if a positive result is obtained in the above SP103 because the continuous print piece number has reached 200, the controller 41 moves to SP105. In SP105 the controller 41 substitutes the parameter b for the frequency adjustment coefficient N and moves to SP106. As mentioned above, the parameter b is set to 1.0 if the environmental value e is 4 or larger, and to 0.7-0.9 if e is 3 or smaller. For example, if the environmental value e=2, the parameter b=0.8, and the frequency adjustment coefficient N=0.8. In this case, the execution frequency becomes 50×0.8=40.

In SP106 the controller 41 judges whether the counter B is no smaller than the parameter Z×the frequency adjustment coefficient N. Here, the parameter Z×the frequency adjustment coefficient N is the execution frequency adjusted based on the environmental value e and the continuous print piece number (the counter A). Therefore, judging whether the counter B is no smaller than the parameter Z×the frequency adjustment coefficient N signifies judging whether the number of pieces printed after the last foreign body removal operation (the counter B) is no smaller than the adjusted execution frequency, that is, whether the timing to execute the foreign body removal operation has come.

If a negative result is obtained in this SP106 because the number of pieces printed after the last foreign body removal operation has not reached the adjusted execution frequency, the controller 41 moves to SP107. In SP107 the controller 41 judges whether the continuous printing is completed. Here, if there exist pages to be printed continuously, the controller 41 obtains a negative result in this SP107, returns to SP100, and continues to print the next page.

As opposed to this, if there exists no page to be printed continuously, the controller 41 obtains a positive result in SP107 and moves to SP108. In SP108 the controller 41 executes the foreign body removal operation and resets the counter A and the counter B, thereby finishing a series of operations.

On the other hand, if a positive result is obtained in the above-mentioned SP106 because the number of pieces printed after the last foreign body removal operation has reached the adjusted execution frequency, the controller 41 moves to SP109. In SP109 the controller 41 judges whether the continuous printing is completed. Here, if the continuous printing is completed, the controller 41 obtains a positive result in this SP109, moves to SP108, executes the foreign body removal operation, and resets the counter A and the counter B, thereby finishing a series of operations.

As opposed to this, if the continuous printing is not completed, the controller 41 obtains a negative result in SP109 and moves to SP110. In SP110 the controller 41 pauses the continuous printing and moves to the next SP111. In SP111 the controller 41 executes the foreign body removal operation.

After the foreign body removal operation is finished, the controller 41 moves to SP112 and resets the counter B. Afterwards, in SP113 the controller 41 resumes the continuous printing, returns to SP100, and continues to print the next page. The controller 41 of the image forming apparatus 100 executes the foreign body removal operation during continuous printing through this kind of procedure.

2-3. Summary and Efficacy

As explained so far, the image forming apparatus 100 of the second embodiment executes the foreign body removal operation also during continuous printing and adjusts the execution frequency of the foreign body removal operation during the continuous printing based on the environmental value e indicating the environment (the temperature T and the humidity H) around the image forming apparatus 100 and the continuous print piece number. That is, if the continuous print piece number is no smaller than the threshold value (200), the higher the temperature T or the humidity H around the image forming apparatus 100 becomes, the higher the execution frequency of the foreign body removal operation the image forming apparatus 100 sets.

In other words, if the continuous print piece number continues to increase in an environment where the temperature T or the humidity H is high (e.g., the temperature T is about 20° C. or higher, or the humidity H is about 30% or higher), that is, if it is supposed that toner and its external additive can easily aggregate and become stuffed in the contact place between the development roller 31 and the regulation blade 33, the image forming apparatus 100 increases the execution frequency of the foreign body removal operation during continuous printing.

By doing so, even in a situation where toner and its external additive can easily aggregate and become stuffed in the contact place between the development roller 31 and the regulation blade 33, the image forming apparatus 100 can sufficiently remove foreign bodies stuffed in the contact place between the development roller 31 and the regulation blade 33.

Here, shown in a table in FIG. 14 are experimental results of verifying the occurrences of print defects such as white streaks when printing was actually performed in an environment of high temperature and high humidity by each of the image forming apparatus 100 of this embodiment and an image forming apparatus (this is called a third comparison target apparatus) that only reverse-rotates the development roller periodically (e.g., every 50 continuously-printed pieces).

As shown in this table, in the third comparison target apparatus, print defects occurred by the time 5000 pieces of the sheet P were printed. As opposed to this, in the image forming apparatus 100 of this embodiment, no print defect occurred until 30000 pieces of sheet P were printed.

As is evident from these experimental results, compared with the third comparison target apparatus (i.e., compared with the conventional image forming apparatuses), the image forming apparatus 100 could suppress print defects. Based on this also, it can be said that the image forming apparatus 100 can sufficiently remove foreign bodies stuffed in the contact place between the development roller 31 and the regulation blade 33 so that no print defect occurs.

3. Other Embodiments

3-1. Other Embodiment 1

Note that in the first and the second embodiments mentioned above, the first voltage value and the second voltage value were respectively set to the regulating voltage and the development voltage, and by the voltage controller 46 changing the regulating voltage and the development voltage from the first voltage values to the second voltage values during the foreign body removal operation, the magnitude relationship between the regulating voltage and the development voltage was reversed from that during the print operation. This invention is not limited to this, but the magnitude relationship between the regulating voltage and the development voltage can be reversed by another method than changing the regulating voltage and the development voltage from the first voltage values to the second voltage values. Note that the magnitude relationship between the regulating voltage and the development voltage is based on comparison in their absolute values.

Specifically, by setting the regulating voltage to a fixed value (e.g., −200 V) and by the voltage controller 46 changing only the development voltage from the first voltage value (e.g., −150 V) to the second voltage value (e.g., −300 V), the magnitude relationship between the regulating voltage and the development voltage can be reversed from the one that the absolute value of the regulating voltage>the absolute value of the development voltage to the one that the absolute value of the regulating voltage<the absolute value of the development voltage. Also, conversely, by setting the development voltage to a fixed value (e.g., −150 V) and by the voltage controller 46 changing only the regulating voltage from the first voltage value (e.g., −200 V) to the second voltage value (e.g., −50 V), the magnitude relationship between the absolute value of the regulating voltage and the absolute value of the development voltage can be reversed.

Also, in this case where the magnitude relationship between the regulating voltage and the development voltage is reversed by fixing one of the regulating voltage and the development voltage and changing the other from the first voltage value to the second voltage value, in the same manner as in the first and the second embodiments, it is desirable that the voltage controller 46 also changes (decreases the absolute value of) the charging voltage.

3-2. Other Embodiment 2

Also, in the first and the second embodiments mentioned above, during the foreign body removal operation, by the voltage controller 46 and the drive controller 43, the drum motor 47 was forward-rotated for the time t1 in a state where the charging voltage, the regulating voltage, and the development voltage were set to the second voltage values, and afterwards the drum motor 47 was reverse-rotated for the time t2 in a state where the charging voltage, the regulating voltage, and the development voltage were turned off.

This invention is not limited to this, but after forward-rotating the drum motor 47 for the time t1 in a state where the charging voltage, the regulating voltage, and the development voltage are set to the second voltage values by the voltage controller 46 and the drive controller 43, the drum motor 47 can be reverse-rotated for the time t2 in a state where the charging voltage, the regulating voltage, and the development voltage are set to the second voltage values. That is, after forward-rotating the drum motor 47 in a state where the magnitude relationship between the regulating voltage and the development voltage is reversed by the voltage controller 46 and the drive controller 43, the drum motor 47 can be reverse-rotated in a state where the magnitude relationship between the regulating voltage and the development voltage is maintained.

In this case, during the period from the point of time S3 to the point of time S4 shown in FIG. 7, that is the period when the drum motor 47 is paused, the charging voltage, the regulating voltage, and the development voltage can be temporarily turned off or maintained at the second voltage values by the voltage controller 46.

3-3. Other Embodiment 3

Furthermore, in the first and the second embodiments mentioned above, during the foreign body removal operation, the drum motor 47 was kept reverse-rotating for the time t2 by the drive controller 43. This invention is not limited to this, but the drive controller 43 can divide the reverse rotation of the drum motor 47 into multiple times and perform them intermittently. Note that in the case of performing the reverse rotation of the drum motor 47 divided into multiple times in this manner, the drive controller 43 can control turning on/off of the drum motor 47 so that the rotation amount of the drum 47 becomes equal to that when the drum motor 47 is kept reverse-rotating for the time t2.

3-4. Other Embodiment 4

Furthermore, in the first and the second embodiments mentioned above, the time t1 in the foreign body removal operation executed in each of the development units 3K, 3Y, 3M, and 3C was set common (1 second). However, this invention is not limited to this, but the controller 41 can separately set (i.e., change) this time t1 among the development units 3K, 3Y, 3M, and 3C for example.

For example, because transfers to the sheet P by the development units 3K, 3Y, 3M, and 3C are completed sequentially from the one positioned in the upstream side of the carrying route 4, the foreign body removal operation can be started first with the development unit 3 that completed the transfer to the sheet P, and the earlier the starting time of the foreign body removal operation of the development unit 3 is, the longer the time t1 in the foreign body removal operation can be set.

Also, this invention is not limited to this, but the time t1 in the foreign body removal operation can be separately set among toners used by the development units 3K, 3Y, 3M, and 3C. In fact, toners occasionally have different aggregation characteristics (easiness to aggregate) depending on the kinds of their external additives, etc. Then, the controller 41 should set the time t1 in the foreign body removal operation according to the toner used by the development unit 3. Specifically, the easier the toner used by the development unit 3 aggregates, the longer the time t1 in the foreign body removal operation should be set.

Also, this invention is not limited to this, but the time t1 in the foreign body removal operation can be set according to the temperature or humidity of each of the development units 3K, 3Y, 3M, and 3C for example. In fact, the higher the temperature or the humidity is, the easier it becomes for toner to aggregate. Then, the higher the temperature or the humidity the development unit 3 has, the longer the time t1 in the foreign body removal operation the controller 41 should set. Note that in this case, a sensor to measure temperature and humidity can be separately installed inside or in the vicinity of each of the development units 3 for example.

Also, for example, if it can be predicted which of the development units 3 will have high temperature (e.g., if it can be predicted that the development unit 3C close to the fuser 19 will have higher temperature than the others), the time t1 in the foreign body removal operation executed in that development unit 3 can be set longer than the time t1 in the foreign body removal operations executed in the other development units 3. Furthermore, the time t1 in the foreign body removal operation can be set according to the toner remaining amounts of the development units 3K, 3Y, 3M, and 3C.

Note that if the image forming apparatuses 1 and 100 are provided with a mechanism to allow separate driving of the development units 3K, 3Y, 3M, and 3C, the controller 41 can set the time t2 in the foreign body removal operation also separately for each of the development units 3K, 3Y, 3M, and 3C in the same manner.

Also, instead of setting the time t1 in the foreign body removal operation separately for each of the development units 3K, 3Y, 3M, and 3C, for example, during the foreign body removal operation, for only a particular development unit 3 among the development units 3K, 3Y, 3M, and 3C, the controller 41 can change the voltages to the second voltage values, forward-rotate the development roller 31 for the time t1, and then reverse-rotate it, and for the other development units 3, just reverse-rotate the development roller 31 during the foreign body removal operation.

For example, only for the development unit 3 whose foreign bodies cannot be sufficiently removed by just reverse-rotating the development roller 31 because of using easily-aggregatable toner, being disposed in a place reaching high temperature, etc., during the foreign body removal operation, the voltages can be changed to the second voltage values, and the development roller 31 can be forward-rotated and then reverse-rotated.

3-5. Other Embodiment 5

Furthermore, in the first and the second embodiments mentioned above, each of the development units 3K, 3Y, 3M, and 3C was provided with a gear connected to the drive shaft driven by the drum motor 47 and a gear that transmits a driving force supplied from the drum motor 47 through this gear to each of the photosensitive drum 5, the development roller 31, and the supply roller 32. That is, each of the development units 3K, 3Y, 3M, and 3C drives the photosensitive drum 5, the development roller 31, and the supply roller 32 connected with gears based on the driving force supplied from one drive shaft.

This invention is not limited to this, but for example, each of the development units 3K, 3Y, 3M, and 3C can be provided with two pieces of couplings, each of which is connected with each of two drive shafts driven by the drum motor 47, the photosensitive drum 5 is rotated by a driving force supplied through one coupling, and the development roller 31 and the supply roller 32 connected with gears can be rotated by a driving force supplied through the other coupling. In this case, if the two drive shafts can be separately driven by the drum motor 47, the drum motor 47 can drive only the development roller 31 and the supply roller 32 to perform the foreign body removal operation.

Also, this invention is not limited to this, but each of the development units 3K, 3Y, 3M, and 3C can be provided with three pieces of couplings, and the photosensitive drum 5, the development roller 31, and the supply roller 32 can be separately driven. By doing so, for example, the drum motor 47 can drive only the development roller 31 to perform the foreign body removal operation.

3-6. Other Embodiment 6

Furthermore, in the second embodiment mentioned above, during the foreign body removal operation, the drum motor 47 was forward-rotated for the time t1 in a state where the charging voltage, the regulating voltage, and the development voltage were set to the second voltage values by the voltage controller 46 and the drive controller 43, and afterwards the drum motor 47 was reverse-rotated for the time t2 in a state where the charging voltage, the regulating voltage, and the development voltage were turned off. This invention is not limited to this, but for example, the control of forward-rotating the drum motor 47 for the time t1 in a state where the charging voltage, the regulating voltage, and the development voltage are set to the second voltage values can be omitted from the foreign body removal operation.

In this case, in the image forming apparatus 100, although the drum motor 47 is only reverse-rotated during the foreign body removal operation, by appropriately adjusting (increasing) the execution frequency of the foreign body removal operation, foreign bodies stuffed in the contact place between the development roller 31 and the regulation blade 33 can be sufficiently removed so that no print defect will occur.

Also, this invention is not limited to this, but for example, at the timing of executing the foreign body removal operation, the controller 41 can select and execute one of the foreign body removal operation that only reverse-rotates the drum motor 47 (this is called the simple foreign body removal operation) and the foreign body removal operation that forward-rotates the drum motor 47 in a state where the voltages are set to the second voltage values and afterwards reverse-rotates the drum motor 47 (this is called the normal foreign body removal operation). For example, the simple foreign body removal operation and the normal foreign body removal operation can be alternately selected and executed in such a manner that if the simple foreign body removal operation was performed last time, the normal foreign body removal operation is performed this time. Also, the simple foreign body removal operation can be selected and executed until the continuous print piece number exceeds a threshold value (e.g., 200), and the normal foreign body removal operation can be selected and executed after the threshold value is reached. Furthermore, the simple foreign body removal operation can be selected and executed if the environmental value e exceeds a threshold value (e.g., 3), and the normal foreign body removal operation can be selected and executed if it is equal to or smaller than the threshold value.

3-7. Other Embodiment 7

Furthermore, in the second embodiment mentioned above, the controller 41 acquired the temperature T and the humidity H from the temperature and humidity sensor 23 as the environmental information indicating the environment around the development units 8, and adjusted the execution frequency of the foreign body removal operation using the environmental value e that varies according to these temperature T and humidity H. This invention is not limited to this, but the controller 41 can acquire one of the temperature T and the humidity H as the environmental information, and adjusts the execution frequency of the foreign body removal operation using the environmental value that varies according to one of the temperature T and the humidity H.

Also, this invention is not limited to this, but instead of the temperature T measured by the temperature and humidity sensor 23, the internal temperature measured by the internal temperature sensor 24 can be used as the environmental information. Also, for example, a temperature sensor can be installed inside or in the vicinity of each of the development units 8, and temperature measured by this temperature sensor can be used as the environmental information. In this case, for example, the average of the temperatures measured in the development units 8 or the highest temperature can be used as the environmental information.

Also, although in the image forming apparatus 100, temperature and humidity were used as the environmental information indicating the environment around the development units 8, this invention is not limited to this, but any information influencing the toner aggregation characteristic (such as water vapor amount calculated using temperature and humidity) can be used as the environmental information.

3-8. Other Embodiment 8

Furthermore, in the second embodiment mentioned above, only if the continuous print piece number was 200 or larger and the environmental value e was 3 or smaller, the controller 41 adjusted the execution frequency of the foreign body removal operation. This is just an example, and for example, the execution frequency can be adjusted so that the range of the environmental value e for adjusting the execution frequency is enlarged as the continuous print piece number increases in such a manner that the environmental value e must be 1 if the continuous print piece number is 50 or larger and smaller than 100, the environmental value e must be 2 or smaller if the continuous print piece number is 100 or larger and smaller than 150, the environmental value e must be 3 or smaller if the continuous print piece number is 150 or larger and smaller than 200, and so on.

3-9. Other Embodiment 9

Furthermore, although in the first and the second embodiments mentioned above, this invention was applied to the image forming apparatuses 1 and 100 that are electrophotographic printers, this invention is not limited to these, but it can also be applied to any other image forming apparatus such as a copier or a multifunction peripheral having a different configuration from those of the image forming apparatuses 1 and 100, as far as the image forming apparatus is provided with the development unit 8 having the development roller 31 and the regulation blade 33 that regulates the layer thickness of toner on the development roller 31.

3-10. Other Embodiment 10

Also, although in the embodiments mentioned above, each of the development units 3 was provided with the photosensitive drum 5 as a specific example of the image carrier, this invention is not limited to this, but each of the development units 3 can be provided with a different image carrier from the photosensitive drum 5 as far as it can carry an electrostatic latent image. Furthermore, although each of the development units 3 was provided with the charging roller 6 as a specific example of the charging member, this invention is not limited to this, but each of the development units 3 can be provided with a different charging member from the charging roller 6 as far as it can uniformly charge the image carrier. Furthermore, although each of the development units 3 was provided with the LED head 7 as a specific example of the exposure part, this invention is not limited to this, but each of the development units 3 can be provided with a different exposure part from the LED head 7 as far as it can form an electrostatic latent image on the image carrier.

Furthermore, although in the embodiments mentioned above, each of the development units 3 was provided with the development roller 31 as a specific example of the developer carrier, this invention is not limited to this, but each of the development units 3 can be provided with a different developer carrier from the development roller 31 as far as it can supply a developer to the image carrier. Furthermore, although each of the development units 3 was provided with the supply roller 32 as a specific example of the developer supply member, this invention is not limited to this, but each of the development units 3 can be provided with a different developer supply member from the supply roller 32 as far as it can supply a developer to the developer carrier. Furthermore, each of the development units 3 was provided with the regulation blade 33 as a specific example of the regulating member, this invention is not limited to this, but each of the development units 3 can be provided with a different regulating member from the regulation blade 33 as far as it can regulate the developer on the developer carrier.

Furthermore, although in the embodiments mentioned above, the image forming apparatuses 1 and 100 were provided with the controller 41 that was a specific example of the controller and the setting part, the voltage controller 46 that was a specific example of the voltage controller, and the drive controller 43 that was a specific example of the drive controller. This invention is not limited to this, but for example, instead of the controller 41, the voltage controller 46, and the drive controller 43, the image forming apparatuses 1 and 100 can be provided with one controller that has their functions in one unit. Also, for example, instead of the controller 41, the image output part 42, the drive controller 43, the fusion controller 44, the exposure controller 45, and the voltage controller 46, the image forming apparatuses 1 and 100 can be provided with one controller that has their functions in one unit.

Furthermore, although in the embodiments mentioned above, the image forming apparatuses 1 and 100 were provided with the temperature and humidity sensor 23 and the internal temperature sensor 24 as specific examples of the temperature and humidity detection part, this invention is not limited to this, but an arbitrary number of sensors can be provided in different positions from those of the temperature and humidity sensor 23 and the internal temperature sensor 24 as far as they can detect temperature and humidity around the contact place between the developer carrier and the regulating member.

3-11. Other Embodiment 11

Furthermore, this invention is not limited to the embodiments mentioned above. That is, the scope of this invention includes embodiments that arbitrarily combine parts or the whole of the embodiments and other embodiments mentioned above, and embodiments that extract parts of them.

This invention can be widely utilized in image forming apparatuses that have a regulation blade that regulates the layer thickness of toner on the development roller.

In the invention, the charging voltage, regulating voltage and development voltage may be constant with respect to time, however, they may fluctuate. These voltages may be composed with pulsating components as long as each of their average values satisfies the relationships described above. The pulsating is one of wave types that is a combination of direct voltage and alternating voltage. Also, these voltages may be composed with pulsating components as long as each of their peak value does not switch its polarity between the positive and the negative, which are positioned sandwiching zero voltage (0 volt.). Further, it is preferred that the relationships of average values among these voltages maintain when these voltages are generated. Putting another way, under a state where an inversion or reversal of the magnitude relationships does not occur when they are generated, each of these voltages may have various values.

What is claimed is:

1. An image forming apparatus comprising:

an image carrier that carries an electrostatic latent image, a developer carrier that supplies a developer to the image carrier, a developer accommodation part that accommodates the developer therein, a developer supply member that supplies the developer accommodated in the developer accommodation part to the developer carrier, a regulating member that is in contact with the developer carrier and regulates the developer on the developer carrier, a voltage controller that controls a development voltage applied to the developer carrier and a regulating voltage applied to the regulating member, and a drive controller that controls a rotation of the developer carrier, wherein the image forming apparatus executes an image formation process through which a developer image is formed on the image carrier by developing the electrostatic latent image with the developer supplied to the image carrier while rotating the developer carrier in one direction, the one direction being defined as a forward direction, the voltage controller controls the development voltage and the regulating voltage after the image formation process such that a magnitude relationship between the development voltage and the regulating voltage becomes inverted from that during the image formation process, and after finishing the image formation process, in a state where the magnitude relationship between the development voltage and the regulating voltage is inverted from that during the image formation, the drive controller rotates the developer carrier in the forward direction for a prescribed period, and afterwards rotates the developer carrier in a reverse direction, which is an opposite direction from the forward direction, for another prescribed period.

2. The image forming apparatus according to claim 1, further comprising:

a controller that has the drive controller and the voltage controller execute an operation that in the state where the magnitude relationship between the development voltage and the regulating voltage is inverted from that during the image formation, the developer carrier is driven in the forward direction for the prescribed period, and afterwards the developer carrier is driven in the reverse direction for the another prescribed period, the operation being defined as a foreign body removal operation, wherein the controller acquires environmental information indicating an environment condition around the contact between the developer carrier and the regulating member, and determines an execution frequency based on which a number of the foreign body removal operation to be executed is determined, and a continuous image forming number based on which a number of the image forming process to be executed is determined, and adjusts the execution frequency based on the based on the environmental information and the continuous image forming number.

3. The image forming apparatus according to claim 1, wherein the inversion of the magnitude relationship between the development voltage and the regulating voltage is achieved by changing one of the development voltage and the regulating voltage, the voltage before the inversion being defined as a first voltage value, and the voltage after the inversion being defined as a second voltage value.

4. The image forming apparatus according to claim 1, further comprising:

a charging member that uniformly charges the image carrier by applying a charging voltage, wherein the voltage controller controls the charging voltage in accordance with the inversion of the magnitude relationship between the development voltage and the regulating voltage, and the charging voltage before the inversion being defined as a first voltage value, and the charging voltage after the inversion being defined as a second voltage value.

5. The image forming apparatus according to claim 4, wherein the absolute value of the second voltage value of the charging voltage is smaller than that of the first voltage value of the charging voltage.

6. The image forming apparatus according to claim 4, wherein the absolute value of the second voltage value of the charging voltage is larger than that of the first voltage value of the charging voltage.

7. The image forming apparatus according to claim 1, wherein determining a settable slowest speed at which the drive controller is able to rotate the developer carrier in the forward direction as slow as possible, the drive controller rotates the developer carrier in the reverse direction at the settable slowest speed.

8. The image forming apparatus according to claim 1, wherein the voltage controller stops applying the development voltage and the regulating voltage when the prescribed period lapses after the inversion of the magnitude relationship is executed, and the drive controller rotates the developer carrier in the forward direction in the state where the magnitude relationship between the development voltage and the regulating voltage is inverted from that during the image formation process for the prescribed period, afterwards rotates the developer carrier in the reverse direction for the another prescribed period in a state where the applications of the development voltage and the regulating voltage are stopped.

9. The image forming apparatus according to claim 1, wherein the voltage controller stops applying the development voltage and the regulating voltage while the drive controller rotates the developer carrier in the reverse direction for the another prescribed period.

10. The image forming apparatus according to claim 1, further comprising:

a temperature and humidity detection part that detects temperature and humidity around the contact between the developer carrier and the regulating member, wherein based on at least one of the temperature and the humidity obtained from the temperature and humidity detection part, the voltage controller adjusts the development voltage and the regulating voltage before their magnitude relationship is inverted, and the development voltage and the regulating voltage after their magnitude relationship is inverted.

11. The image forming apparatus according to claim 1, further comprising:

multiple development units each of having the image carrier, the developer carrier, the developer supply member, and the regulating member, wherein the voltage controller controls the development voltage applied to the developer carrier and the regulating voltage applied to the regulating member of each of the development units, and the drive controller individually controls the prescribed periods during which the developer carriers rotate in the forward direction.

12. The image forming apparatus according to claim 11, wherein the setting part changes, according to a type of the developer used in each of the development units, the prescribed period during which the developer carrier rotates in the forward direction.

13. An image forming apparatus comprising:

an image carrier that carries an electrostatic latent image, a developer carrier that supplies a developer to the image carrier, a developer accommodation part that accommodates the developer therein, a developer supply member that supplies the developer accommodated in the developer accommodation part to the developer carrier, a regulating member that is in contact with the developer carrier and regulates the developer on the developer carrier, a drive controller that controls a rotation of the developer carrier, and a controller that controls the drive controller, wherein the developer carrier rotates in a forward direction for an image formation process through which a developer image is formed on the image carrier by developing the electrostatic latent image with the developer supplied to the image carrier, the drive controller is configured to allow the developer carrier to rotate in a reverse direction, which is an opposite direction from the forward direction, herein the rotation in the reverse direction is defined as a reverse operation, and the controller acquires environmental information indicating the environment around the contact between the developer carrier and the regulating member, and adjusts an execution frequency to have the drive controller execute the reverse operation in a middle of continuous image formation that continuously performs the image formation process, based on the environmental information and a continuous image formation number based on which a number of the image formation process to be executed is determined.

14. The image forming apparatus according to claim 13, further comprising:

a temperature and humidity detection part that detects temperature and humidity around the contact place between the developer carrier and the regulating member, wherein the controller acquires the temperature and the humidity detected by the temperature and humidity detection part as the environmental information, and adjusts the execution frequency based on the temperature, the humidity, and the continuous image formation number.

15. An image forming apparatus comprising:

an image carrier that carries an electrostatic latent image, a developer carrier that supplies a developer to the image carrier, a developer accommodation part that accommodates the developer therein, a developer supply member that supplies the developer accommodated in the developer accommodation part to the developer carrier, a regulating member that is in contact with the developer carrier and regulates the developer on the developer carrier, a drive controller that controls a rotation of the developer carrier, a controller that controls the drive controller, the temperature and humidity detection part that detects temperature and humidity around the contact place between the developer carrier and the regulating member, wherein the developer carrier rotates in a forwards direction for an image formation process through which a developer image is formed on the image carrier by developing the electrostatic latent image with the developer supplied to the image carrier, the drive controller is configured to allow the developer carrier to rotate in a reverse direction, which is an opposite direction from the forward direction, herein the rotation in the reverse direction is defined as a reverse operation, and the controller acquires the temperature and the humidity detected by the temperature and humidity detection part, and adjusts an execution frequency to have the drive controller execute the reverse operation in a middle of continuous image formation that continuously performs the image formation process, based one the temperature, the humidity, and a continuous image formation number based on which a number of the image formation process to be executed is determined, and the controller sets the execution frequency higher as the temperature or the humidity detected by the temperature and the humidity detection part becomes higher, or the continuous image formation number becomes larger.

* * * * *